US005634992A

United States Patent [19]

Kelly et al.

[11] Patent Number: 5,634,992

[45] Date of Patent: Jun. 3, 1997

[54] METHOD FOR HEAT TREATING GAMMA TITANIUM ALUMINIDE ALLOYS

[75] Inventors: Thomas J. Kelly, Cincinnati; Michael J. Weimer; Curtiss M. Austin, both of Loveland; Paul J. Fink, Maineville, all of Ohio; Shyh-Chin Huang, Lapham, N.Y.

[73] Assignee: General Electric Company, Cincinnati, Ohio

[21] Appl. No.: 656,728

[22] Filed: Jun. 3, 1996

Related U.S. Application Data

[63] Continuation of Ser. No. 262,178, Jun. 20, 1994, abandoned.

[51] Int. Cl.[6] ..... C22F 1/18

[52] U.S. Cl. ..... 148/669; 148/671

[58] Field of Search ..... 148/669, 670, 148/671

[56] References Cited

U.S. PATENT DOCUMENTS

| | | | |
|---|---|---|---|
| 4,294,615 | 10/1981 | Blackburn et al. | 420/420 |
| 4,482,398 | 11/1984 | Eylon et al. | 148/421 |
| 4,631,092 | 12/1986 | Ruckle et al. | 148/421 |
| 5,045,406 | 9/1991 | Huang | 428/614 |
| 5,082,506 | 1/1992 | Huang | 148/421 |
| 5,131,959 | 7/1992 | Huang | 148/421 |
| 5,350,466 | 9/1994 | Larsen et al. | 148/669 |
| 5,558,729 | 9/1996 | Kim et al. | 148/671 |

FOREIGN PATENT DOCUMENTS

| | | | |
|---|---|---|---|
| 1-298127 | 12/1989 | Japan . | |
| 4-235262 | 8/1992 | Japan | 148/669 |

OTHER PUBLICATIONS

"Superplasticity of Thermomechanically Processed Gamma Titanium–Aluminides" The Minerals, Metals & Materials Society, 1991 —pp. 253–262.

"Ternary Alloying of Gamma Titanium–Aluminides for Hot–Workability" Mat. Res. Soc. Symp. Proc, vol. 213, 1991 Materials Research Socity pp. 795–800.

*Primary Examiner*—George Wyszomierski

*Attorney, Agent, or Firm*—Andrew C. Hess; David L. Narciso

[57] ABSTRACT

A gamma titanium aluminide alloy article is produced from a piece of cast gamma titanium aluminide alloy by consolidating the gamma titanium aluminide alloy piece at a temperature above the eutectoid to reduce porosity therein, preferably by hot isostatic pressing. The piece is first heat treated at a temperature above the eutectoid for a time sufficient to form a structure of gamma grains plus lamellar colonies of alpha and gamma phases, and thereafter second heat treated at a temperature below the eutectoid to grow gamma grains within the colony structure, thereby reducing the effective grain size of the colony structure. There may follow an additional heat treatment just below the alpha transus to reform any remaining colony structure to produce a structure having isolated alpha-two laths within gamma grains.

10 Claims, 2 Drawing Sheets

METHOD FOR HEAT TREATING GAMMA TITANIUM ALUMINIDE ALLOYS

This application is a continuation of application Ser. No. 08/262,178 filed Jun. 20, 1994, abandoned.

BACKGROUND OF THE INVENTION

This invention relates to the production and heat treating of titanium alloys, and, more particularly, to the preparation and heat treatment of alloys of the gamma titanium aluminide type.

Titanium aluminides are a class of alloys whose compositions include at least titanium and aluminum, and typically some additional alloying elements such as chromium, niobium, vanadium, tantalum, manganese, or boron. The gamma titanium aluminides are based on the gamma phase found at nearly the equiatomic composition, with roughly 50 atomic percent each of titanium and aluminum, or slightly reduced amounts to permit the use of other alloying elements. The titanium aluminides, and particularly the gamma titanium aluminides, have the advantages of low density, good low and intermediate temperature strength and cyclic deformation resistance, and good environmental resistance.

Gamma titanium aluminides can be used in aircraft engines. They potentially have applications such as low-pressure turbine blades and vanes, bearing supports, compressor casings, high pressure and low pressure hangers, frames, and low pressure turbine brush seal supports.

One area of continuing concern in the titanium aluminides, and particularly the gamma titanium aluminides, is their low-to-moderate levels of ductility. Ductility is the measure of how much a material can elongate before it fails, and is linked to other properties such as fracture resistance. The gamma titanium aluminides typically elongate only 1–4 percent at most prior to failure, and have a steeply rising stress-strain curve. Maintaining the strength and resistance of the material to premature failure is therefore highly dependent upon controlling the alloy ductility. Additionally, it is important to maintain good resistance of the material to creep deformation at elevated temperatures.

There is a need for an approach to achieve good mechanical properties in gamma titanium aluminide alloys, and in particular in cast articles which cannot be thermomechanically processed. The approach must permit those properties to be achieved consistently and controllably in the alloys of interest. The present invention fulfills this need, and further provides related advantages.

SUMMARY OF THE INVENTION

The present invention provides a method of improving the ductility of cast gamma titanium aluminide articles by a thermal treatment, without thermomechanical processing. The method is readily accomplished using available heat treatment equipment. The treated articles have acceptable tensile strength, as well as improved ductility and creep strength as compared with those achieved using other heat treatments.

In accordance with the invention, a method of producing a gamma titanium aluminide alloy article comprises the steps of providing a piece of a cast gamma titanium aluminide alloy having a composition capable of forming alpha, alpha-2, and gamma phases, and a eutectoid in which alpha phase decomposes to colonies comprising alpha-2 and gamma phases upon cooling, and consolidating the gamma titanium aluminide alloy piece at a temperature above the eutectoid to reduce porosity therein. The heat treatment of the method includes a first heat treatment of the gamma titanium aluminide piece at a temperature above the eutectoid for a time sufficient to form a structure of gamma grains plus lamellar colonies comprised of alpha and gamma phases. There is a second heat treatment of the gamma titanium aluminide piece at a temperature below the eutectoid to grow gamma grains within the colony structure, thereby reducing the effective grain size of the colony structure.

The approach of the invention is applicable to a wide range of gamma titanium aluminide alloys, such as from about 44 to about 49 atomic percent aluminum, and most preferably from about 46 to about 48.5 atomic percent aluminum, plus other alloying elements. The step of consolidating is preferably accomplished by hot isostatic pressing at a temperature above the eutectoid, most preferably at a temperature of from about 2200° F. to about 2300° F. with an applied hydrostatic pressure. The first heat treatment is preferably performed at a temperature of from about 2100° F. to about 2200° F. for a time of at least about 8 hours. The second heat treatment is preferably performed at a temperature of from about 1800° F. to about 2000° F. for a time of at least about 16 hours.

Optionally, there may be a third heat treatment following the second heat treatment. The third heat treatment is at a temperature above the eutectoid and preferably just below the alpha transus of the alloy. More specifically, in the third heat treatment the piece is heated to a temperature of from about 2300° F. to about 2425° F. for a time of from about ½ to about 8 hours.

The first heat treatment produces a structure of gamma grains plus lamellar colonies comprised of alpha-2 and gamma phases. The second heat treatment causes gamma grains to grow within the prior colonies of alpha-2 and gamma lamella, effectively refining the grain size of the material. The second heat treatment must be relatively long in order to permit the gamma grains to nucleate and grow at the relatively low temperature of the second heat treatment. The second heat treatment is thereby distinguished from a short-time precipitation heat treatment below the eutectoid. The third heat treatment, when used, serves to produce a structure having alpha-two laths within gamma grains.

The present invention permits the heat treatment for improved ductility of gamma titanium alloys, particularly those having about 44–48.5 atomic percent aluminum, that do not respond well to existing types of heat treatments. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
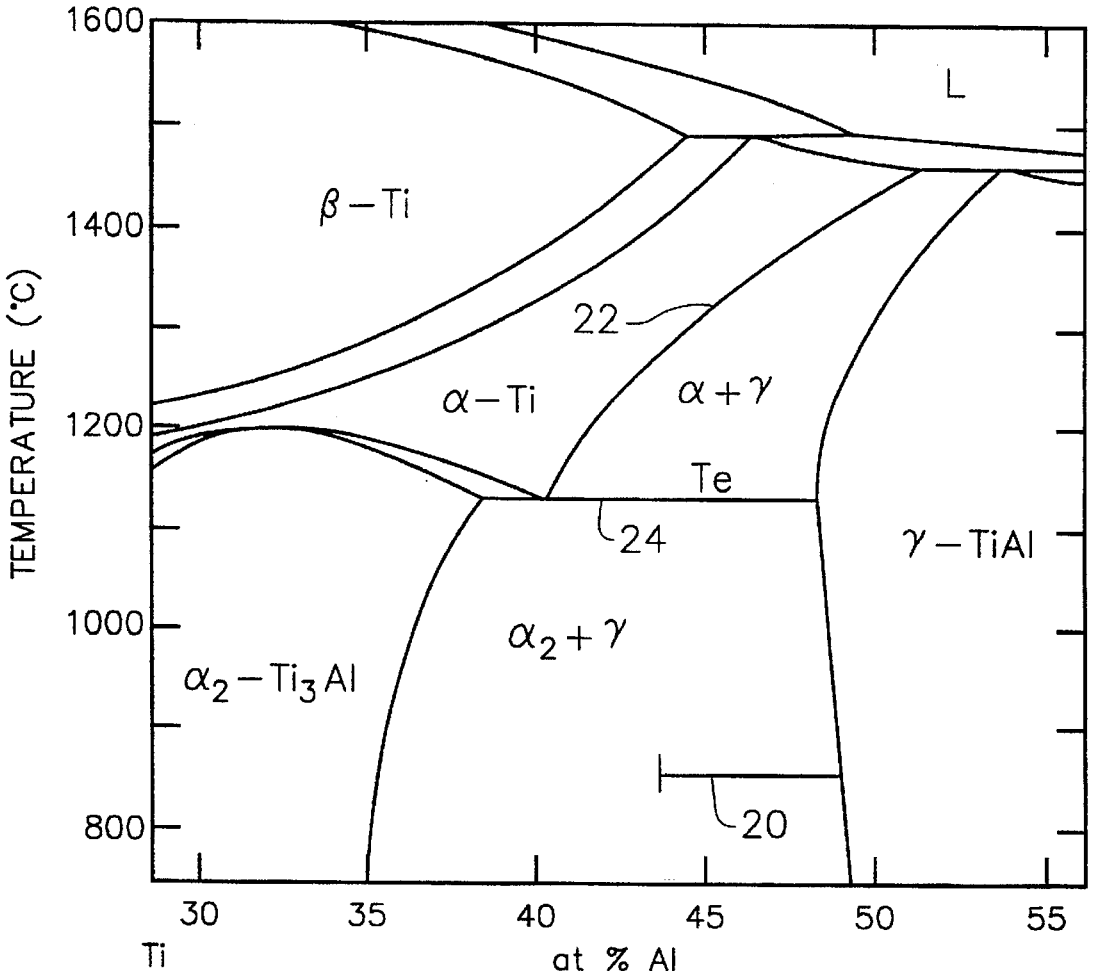
FIG. 1 is a portion of the phase diagram of the titanium aluminide system.

The present invention provides a method of producing a gamma titanium aluminide article, which is based upon the phase transformations in the titanium-aluminum-X system. FIG. 1 shows the central portion of the equilibrium titanium-aluminum phase diagram, and the following discussion refers to that phase diagram. The phase diagram is in atomic percent, and all compositions herein are stated in atomic percent unless indicated to the contrary. The operability of the present invention does not depend upon the accuracy of the phase diagram as depicted, and in fact the phase diagram will vary when other alloying additions X (such as chromium and niobium) are present in the gamma titanium aluminide alloy. The phase diagram is presented as an aid in understanding the processing.

Figure 2:
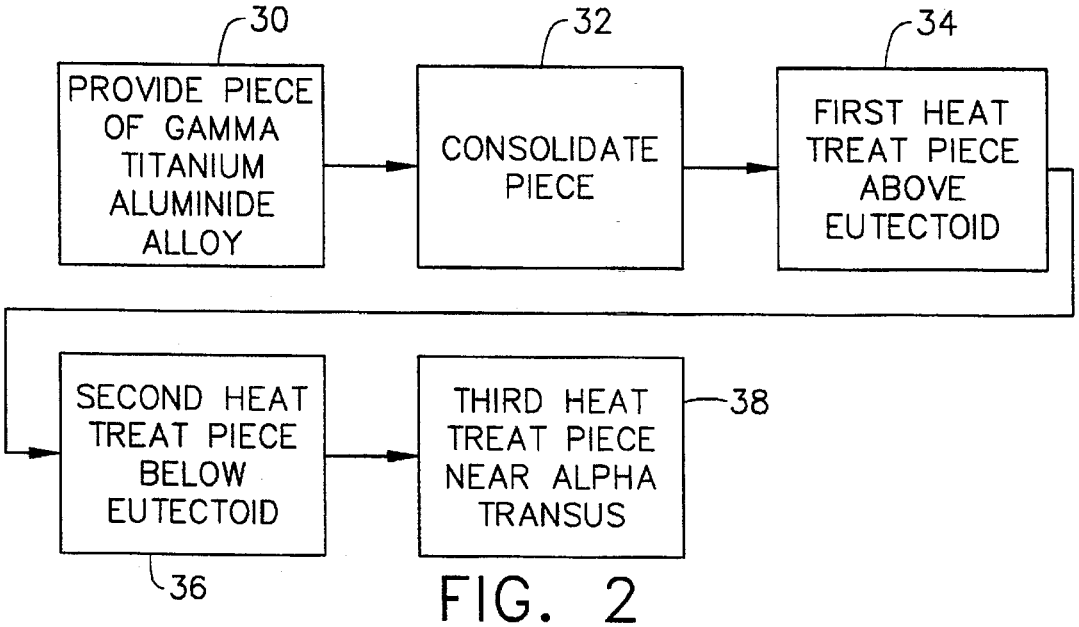
FIG. 2 is a flow chart for the processing approach of the invention.

The invention is applicable to gamma titanium-aluminum alloys which have compositions capable of forming alpha, alpha-2, and gamma phases at the indicated temperatures, and such an alloy is first provided, numeral 30 of FIG. 2. (These alloys are often termed "gamma" titanium aluminides in the art, even though they are not fully within the gamma phase field. That usage is adopted here.) The preferred compositions have from about 44 to about 49 atomic percent aluminum, as indicated at numeral 20. The most preferred compositions are from about 46.0 to about 48.5 atomic percent aluminum. High aluminum content alloys are naturally more ductile than those with low aluminum contents. The gamma titanium aluminides with aluminum in the 45.5–46.5 atomic percent range are inherently of low ductility and do not respond well to conventional heat treatments which seek to increase the elongation. The present approach is particularly useful for increasing the elongations of these alloys.

When such a composition in the broad range is cooled from the molten state, it passes through a high-temperature peritectic reaction and into the alphatitanium phase field (termed herein an "alpha" phase). Upon cooling, the alloy passes into an alpha-plus-gamma phase field. The line between the alpha and alpha-plus-gamma phase fields is termed the alpha transus 22. Upon further cooling, the alloy passes through a eutectoid temperature 24 and into an alpha-2 -plus-gamma phase field, wherein the high-temperature alpha lamella transform to alpha-2.

When such an alloy is melted and cooled as indicated, the piece may have a considerable amount of porosity, and its microstructure is irregular. These characteristics lead to low and uncontrolled ductility. The alloy piece is therefore processed by the present approach to improve these properties.

A preferred processing for the piece is first to reduce the porosity by consolidation of the piece, numeral 32 of FIG. 2, and then to establish a favorable microstructure by heat treatment, numerals 34, 36, and 38 of FIG. 2. The consolidation involves a slight shrinkage of the piece as porosity is removed, but there is no gross deformation as is often used in thermomechanical processing of materials. Thus, the present processing is adapted for improving alloys to be used in essentially their as-cast form.

Consolidation step 32 is preferably accomplished by hot isostatic pressing (known as "HIP'ing"). The piece is heated to the HIP'ing temperature, and an external pressure is applied. The hot isostatic pressing is accomplished at a temperature that is between the alpha transus 22 and the eutectoid 24 for the particular composition of the alloy. The hot isostatic pressing is preferably performed at a temperature of from about 2200° F. to about 2300° F. with an applied hydrostatic pressure. The applied hydrostatic pressure is greater than about 20,000 pounds per square inch (psi), preferably from about 20,000 to about 30,000 pounds per square inch, and most preferably from about 25,000 to about 30,000 pounds per square inch. The hot isostatic pressing must be of sufficient duration to close the porosity. From about 1 to about 20 hours is preferred, and from about 2 to about 8 hours is most preferred. If the temperature, the pressure, or the duration is too low, the porosity cannot be successfully closed. The temperature is preferably limited so that the hot isostatic pressing is accomplished in the alpha plus gamma phase field to begin the required transformations. The upper limits of pressure and time are selected for process economics.

During the isostatic pressing operation, the phase transformations to the final structure begin. Consolidation at a temperature below the alpha transus produces an alpha plus gamma structure. Upon cooling from this treatment, the alpha phase transforms to alternating platelets of gamma plus alpha-2 phases. The result is gamma phase grains mixed with colonies of a gamma plus alpha-2 lamellar structure.

Figure 3:
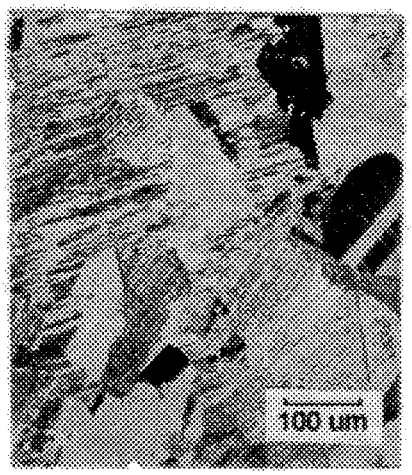
FIG. 3 is a photomicrograph of a gamma titanium aluminide piece after the first heat treatment.

After consolidation 32, the piece is first heat treated, numeral 34. In the first heat treatment, the piece is heated to a temperature above the eutectoid 24 for a time sufficient to form a colony structure of alpha and gamma phases. Desirably, the temperature is about 25° F.–75° F. above the eutectoid temperature, allowing for some variation due to the heating equipment used. Thus, a preferred heating range is from about 2100° F. to about 2200° F., for a time of at least about 8 hours, and preferably for a time of from about 15 to about 25 hours. This temperature range is low in the alpha plus gamma field, so that the volume fractions of gamma phases are maximized. If the piece is treated at higher temperatures, the alpha fraction is relatively larger than the gamma fraction, resulting in reduced ductility. A most preferred first heat treatment utilizes a temperature of 2150° F. and a soaking time of about 20 hours. After the desired time at temperature, the piece is cooled. FIG. 3 illustrates the microstructure obtained with the first heat treatment.

After the first heat treatment 34, the piece is given a second second heat treatment, numeral 36. In the second heat treatment, gamma phase grains are formed and grow within the colony structure produced by the first heat treatment 34. The gamma phase grains act to reduce the effective grain size of the structure, thereby refining the structure. In addition, the amount of alpha-2 within the colonies is reduced, possibly contributing to the increased creep strength of the final product.

Figure 4:
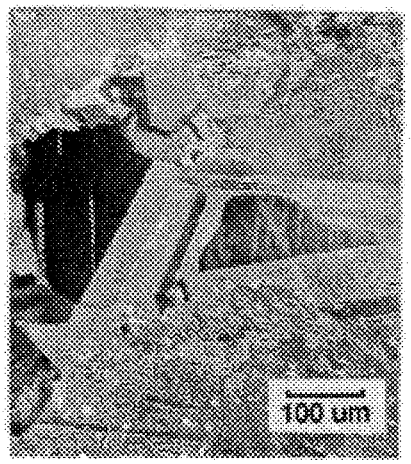
FIG. 4 is a photomicrograph of a gamma titanium aluminide piece after the second heat treatment.

To accomplish the transformation of the second heat treatment, the piece is heated to a temperature about 100° F.–300° F. below the eutectoid. Thus, a preferred heating range for the second heat treatment 36 is from about 1800° F. to about 2000° F., for a time of at least about 8 hours and preferably for a time of from about 40 to about 50 hours. Shorter heat treatment times do not allow sufficient gamma grain formation, leading to reduced toughness and thin-section ductility. Longer heat treatment times are uneconomical. The heat treat temperature cannot be just below the eutectoid, as there must be a sufficient undercooling to permit nucleation of the gamma grains. A most preferred second heat treatment utilizes a temperature of 1850° F. and a soaking time of about 50 hours. This extended time at temperature is utilized in order to obtain the desired nucleation and grain growth of the gamma grains at this relatively low temperature. It also produces minor amounts of B2. Thus, the time at the second heat treatment temperature should not be less than that indicated above, or the required grain structure will not result. FIG. 4 illustrates the refined microstructure obtained after the second heat treatment 36.

Optionally, after the first and second heat treatments are complete, the piece may be provided a third heat treatment, numeral 38. In the third heat treatment, the piece is heated to a temperature relatively high within the alpha-plus-gamma phase field. The third heat treatment reforms the remaining colony structure, eliminates any beta phase present, and forms alpha-two plates within the gamma grains. This structure provides even further improved ductility, at the cost of a reduction in creep strength. Material produced by this approach would normally be intended for use at lower service temperatures where creep is of less concern than the need for improved ductility and fracture resistance.

Figure 5:
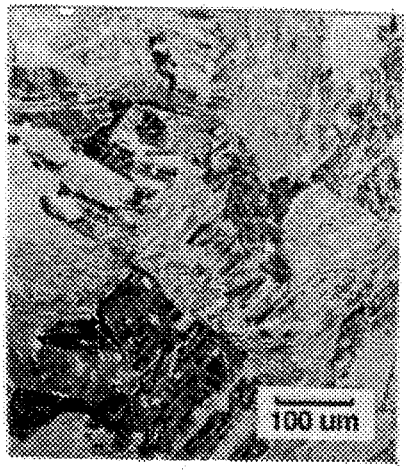
FIG. 5 is a photomicrograph of a gamma titanium aluminide piece after the third heat treatment.

Thus, a preferred heating range for the third heat treatment 36 is from about 2300° F. to about 2425° F. for a time of at least about ½ hour and preferably for a time of from about ½ to about 8 hours. Shorter heat treatment times are impractical to obtain a uniform temperature throughout the article, while longer times result in dissolution of the gamma grains formed during the second heat treatment. FIG. 5 illustrates the microstructure obtained after the third heat treatment 38.

The approach of the invention has been verified by a number of tests of titanium aluminide specimens prepared according to the approach just described, and the results of the tests are presented in the following table. The specimens had a nominal composition of Ti, 45–47 atomic percent Al (the exact aluminum content is given in the following table), and nominally 2 atomic percent chromium and 2 atomic percent niobium. In each case, the specimens were cast of the indicated composition, consolidated by hot isostatic pressing at 2200° F. for 3 hours, with an applied hydrostatic pressure of 25,000 psi. All specimens were given the first and second heat treatments, and some were given the third heat treatment.

In the following table, the aluminum percentage is in atomic percent. The test specimen is either from the airfoil ("blade") or dovetail ("DT") of the turbine blade. Treatments are indicated by a code letter A–D. Treatment A is a temperature of 2325° F. for 20 hours in argon; Treatment B is a temperature of 2150° F. for 20 hours, 1850° F. for 45 hours, and 2300° F. for 1 hour, all in helium; Treatment C is 2150° F. for 20 hours and 1850° F. for 45 hours, both in helium; and Treatment D is 2150° F. for 20 hours in helium. Elongation to failure is given in percent, and the 0.2 percent yield strength and ultimate tensile strength are given in thousands of pounds per square inch, or KSI. Creep tests were performed on blades only at 1400° F. with an applied load of 15,000 pounds per square inch. The results are specified in "%El/time". That is, 0.2/20 means that a creep elongation of 0.2 percent was reached in 20 hours.

TABLE

| Sample No. | % Al | Test Form | Treat-ment | % Fl | 2% YS | UTS | Creep |
|---|---|---|---|---|---|---|---|
| 17 | 46.5 | Blade | A | 1.8 | 53.6 | 74.3 | 0.2/7 |
| 18 | 46.5 | DT | A | 0.95 | 48.9 | 58.5 | |
| 19 | 45.6 | Blade | A | 1.7 | 56.4 | 76.6 | 0.2/32 |
| 20 | 45.6 | DT | A | 0.9 | 53.2 | 64.6 | |
| 21 | 46.5 | Blade | B | 2.0 | 53.4 | 77.1 | 0.2/18 |
| 22 | 46.5 | DT | B | 1.6 | 51.3 | 68.9 | |
| 23 | 46.4 | Blade | B | 2.0 | 55.4 | 77.2 | 0.2/20 |

TABLE-continued

| Sample No. | % Al | Test Form | Treat-ment | % Fl | 2% YS | UTS | Creep |
|---|---|---|---|---|---|---|---|
| 24 | 46.4 | DT | B | 1.8 | 49.7 | 67.7 | |
| 25 | 45.9 | Blade | B | 2.0 | 52.4 | 72.4 | 0.2/22 |
| 26 | 45.9 | DT | B | 1.4 | 49.4 | 63.1 | |
| 27 | 46.3 | Blade | C | 2.0 | 54.4 | 70.9 | 0.2/65 |
| 28 | 46.3 | DT | C | 1.6 | 52.8 | 67.1 | |
| 29 | 45.9 | Blade | C | 1.5 | 59.3 | 74.1 | 0.2/60 |
| 30 | 45.9 | DT | C | 1.1 | 57.3 | 68.4 | |
| 31 | 46.2 | Blade | C | 1.5 | 60.2 | 74.2 | 0.2/130 |
| 32 | 46.2 | DT | C | 1.5 | 56.4 | 69.4 | |
| 33 | 46.5 | Blade | D | 1.7 | 55.3 | 72.5 | 0.6/60 |
| 34 | 46.5 | DT | D | 1.1 | 53.3 | 65.6 | |

Treatments A and D yield poor creep results. Treatment C, the treatment utilizing the first heat treatment 34 and the second heat treatment 36, achieves good elongation and excellent creep resistance. Treatment B, the treatment utilizing the first heat treatment 34, the second heat treatment 36, and the third heat treatment 38, achieves better elongations than treatment C, but at the cost of reduced creep performance.

This invention has been described in connection with specific embodiments and examples. However, those skilled in the art will recognize various modifications and variations of which the present invention is capable without departing from its scope as represented by the appended claims.

What is claimed is:

1. A method producing a gamma titanium aluminide alloy article, comprising the steps of:

providing a piece of cast gamma titanium aluminide alloy having a composition capable of forming alpha, alpha-2, and gamma phases, and a eutectoid in which alpha phase decomposes to colonies comprising alpha-2 and gamma phase upon cooling, the piece of cast gamma titanium aluminide alloy having an aluminum content of from about 45.5 to about 48.5 atomic percent consolidating the gamma titanium aluminum alloy piece at a temperature above the eutectoid to reduce porosity therein;

first heat treating the gamma titanium aluminide piece at a temperature above the eutectoid for a time sufficient to form a structure of gamma grains plus lamellar colonies comprised of alpha-2 and gamma phases, wherein the step of first heat treating includes the steps of heating the piece to a temperature of from about 2100° F. to about 2200° F. for a time of at least 8 hours; and thereafter second heat treating the gamma titanium aluminide piece at a temperature below the eutectoid to grow gamma grains within the colony structure, thereby reducing the effective grain size of the colony structure, wherein the step of second heat treating includes the step of heating the piece to a temperature of from about 1800° F. to about 2000° F. for a time of at least about 8 hours.

2. The method of claim 1, wherein the step of providing includes the step of hot isostatic pressing the piece at a temperature above the eutectoid.

3. The method of claim 2, wherein the step of hot isostatic pressing includes the step of heating the piece to a temperature of from about 2200° F. to about 2300° F. with an applied hydrostatic pressure.

4. The method of claim 1, further including an additional step, after the step of the second heat treating, of third heat treating the piece at a temperature of from about 2300° F. to about 2450° F. for a time of from about ½ hour to about 8 hours.

5. A method of producing a gamma titanium aluminide alloy article, comprising the steps of:

providing a piece of cast gamma titanium aluminum alloy having a composition capable of forming alpha, alpha-2, and gamma phases, and having a eutectoid in which the alpha phase decomposes to alpha-2 and gamma phases upon cooling, the piece of the cast gamma titanium aluminide alloy having an aluminum content of from about 45.5 to about 48.5 atomic percent;

consolidating the piece at a temperature above the eutectoid to reduce porosity therein; and first heat treating the piece at a temperature of about 25° F. to about 75° F. above the eutectoid for a time of at least about 8 hours; and thereafter second heat treating the piece at a temperature of from about 100° F. to about 300° F. below the eutectoid for a time of at least about 8 hours.

6. The method of claim 5, wherein the step of consolidating includes the step of hot isostatic pressing the piece at a temperature above the eutectoid.

7. The method of claim 6, wherein the step of hot isostatic pressing includes the step of heating the piece to a temperature of from about 2200° F. to about 2300° F. with an applied hydrostatic pressure.

8. The method of claim 5, wherein the step of first heat treating includes the step of heating the piece to a temperature of from about 2100° F. to about 2200° F. for a time of at least about 8 hours.

9. The method of claim 5, wherein the step of second heat treating includes the step of heating the piece to a temperature of from about 1800° F. to about 2000° F. for a time of at least about 8 hours.

10. The method of claim 5, further including an additional step, after the step of second heat treating, of third beat treating the piece at a temperature of from about 2300° F. to about 2450° F. for a time of from about ½ hours to about 8 hours.

* * * * *